US005196640A

United States Patent [19]

Asahi et al.

[11] Patent Number: 5,196,640

[45] Date of Patent: Mar. 23, 1993

[54] CONTROL MECHANISM FOR ELECTRONIC MUSICAL INSTRUMENT

[75] Inventors: Yasuhiko Asahi; Satoshi Suzuki; Minoru Kitamura; Toshiyuki Suzuki, all of Hamamatsu, Japan

[73] Assignee: Yamaha Corporation, Hamamatsu, Japan

[21] Appl. No.: 833,808

[22] Filed: Feb. 10, 1992

Related U.S. Application Data

[63] Continuation of Ser. No. 450,051, Dec. 13, 1989, abandoned.

[30] Foreign Application Priority Data

| | | | |
|---|---|---|---|
| Dec. 27, 1988 | [JP] | Japan | 69-330168 |
| Dec. 27, 1988 | [JP] | Japan | 63-330169 |
| Dec. 27, 1988 | [JP] | Japan | 63-330170 |
| Jan. 19, 1989 | [JP] | Japan | 1-4830 |

[51] Int. Cl.[5] ..... G10H 1/02; G10H 1/06

[52] U.S. Cl. ..... 84/692; 84/711; 84/718

[58] Field of Search ..... 84/626-633, 84/644, 662-665, 670, 701-711, 718, 719, 737-741, 743, 744, DIG. 7, 622-625, 659-661, 692-700

[56] References Cited

U.S. PATENT DOCUMENTS

| | | | |
|---|---|---|---|
| 3,257,494 | 6/1966 | Starck | 84/711 |
| 4,078,464 | 3/1978 | Sugiyama | 84/718 |
| 4,352,310 | 10/1982 | Orlandoni | 84/744 |
| 4,915,002 | 4/1990 | Dornes | 84/692 |
| 4,966,053 | 10/1990 | Dornes | 84/718 |

FOREIGN PATENT DOCUMENTS 59-1270 1/1984 Japan .

*Primary Examiner*—Stanley J. Witkowski

*Attorney, Agent, or Firm*—Graham & James

[57] ABSTRACT

A musical tone control mechanism for an electronic musical instrument in which a musical tone adjustment rotary body having a rotating shaft extending along the longitudinal direction of a keyboard is provided, the rotary body is divided into a plurality of parts, and an operation position of the rotary body is movable along the longitudinal direction of the keyboard, or a means for selecting an adjustment function of the rotary body is arranged. The musical tone control mechanism further includes an operation amount detector for detecting an operation amount of the rotary body as a pivot amount of a pivot shaft body of the operation amount detector, cylindrical intermediate members fitted to both ends of the rotary body for connecting the pivot shaft body to the rotary body, and bearings having bearing holes for pivotally receiving the intermediate members.

14 Claims, 11 Drawing Sheets

CONTROL MECHANISM FOR ELECTRONIC MUSICAL INSTRUMENT

This is a continuation of the application, Ser. No. 07/450,051, filed Dec. 13, 1989, which has been abandoned.

BACKGROUND OF THE INVENTION

1. Field of the Invention

The present invention relates to an electronic musical instrument and, more particularly, to a musical tone control mechanism for controlling a volume level and the like during a performance.

2. Description of the Prior Art

Various types of electronic musical instruments have been developed, and such an electronic musical instrument generally comprises a sound source oscillator, an acoustic waveform shaper, an amplifier, a speaker, and various electronic control circuits and generates musical tones upon operations of various buttons arranged on a keyboard and an operation board. In such an electronic musical instrument, musical tone adjustment operations such as operations for adjusting tone colors, pitches and volume levels of electronic musical tones generated by the instrument are required. These musical tone adjustment operations are preferably performed in correspondence with keyboard areas of melody and musical accompaniment parts.

As a conventional musical tone control mechanism for an electronic musical instrument, an electronic musical instrument having a rotary volume control unit along a keyboard is disclosed in Japanese Utility Model Publication No. Sho 59-1270. In this conventional electronic musical instrument, a columnar volume control member longer than the keyboard is arranged along the keyboard, and the volume control member is rotated by a hand, which also operates the keyboard at the same time, to manually adjust the volume level.

In the conventional electronic musical instrument, since one columnar volume control member is arranged along the keyboard, it is impossible to adjust musical tones in correspondence with performance parts such as melody and musical accompaniment parts corresponding to the keyboard areas. In addition, the performer may erroneously operate the rotary body during a performance of a keyboard part which does not require musical tone adjustment, such as a keyboard solo part.

This rotary body can only control the volume level, but cannot adjust tone colors, pitches, and other musical tone functions. In order to adjust these additional musical tone functions, other control mechanisms must be arranged, thus complicating the arrangement of the electronic musical instrument.

Furthermore, it is difficult to operate the rotary body by a palm of a hand with an appropriate force, and a rotating shaft of a volume control connected to the rotary body is overloaded to deform the rotating shaft or result in failure in the volume control.

SUMMARY OF THE INVENTION

It is an object of the present invention to provide a musical tone control mechanism capable of adjusting musical tones corresponding to depressed keys during a performance in units of keyboard areas.

It is another object of the present invention to provide a musical tone control mechanism capable of preventing a performer from erroneously touching a rotary body.

It is still another object of the present invention to provide a musical tone control mechanism for easily controlling various functions of musical tones without complicating its structure.

It is still another object of the present invention to provide a musical tone control mechanism capable of effectively preventing deformation of a pivot shaft of a volume control connected to a rotary body by an external load.

In order to achieve the above objects of the present invention, there is provided a musical tone control mechanism for an electronic musical instrument which has a musical tone adjustment rotary body having a rotating shaft extending along a longitudinal direction of the keyboard, the rotary body being located in front of the keyboard, wherein the rotating shaft is divided into a plurality of rotating shaft portions, and operation positions of the rotary bodies are movable along the longitudinal direction of the keyboard, or a rotary body adjustment function selecting means is arranged.

The rotary body normally has a pivot shaft body, and the musical tone control mechanism also comprises an operation amount detector for detecting an operation amount of the rotary body as a pivot amount of the pivot shaft body, cylindrical intermediate members respectively fitted to both ends of said rotary body, for connecting the pivot shaft body and the rotary body, and bearings having bearing holes for pivotally supporting the intermediate member.

With the above arrangement, the rotating shaft is divided into a plurality of shaft portions, the operation positions of the rotary body are movable along the longitudinal direction of the keyboard, or the rotary body adjustment function selecting means is arranged. Therefore, a rotary body located at a position corresponding to a key depressed during a musical performance can be operated by a hand which depresses the key, thereby performing musical tone adjustment in accordance with the operated keyboard position. In this case, the portion in front of the keyboard portion which does not require musical tone adjustment is excluded from a rotary operation position. The hand which depresses a key on the keyboard cannot touch the portion in front of this keyboard portion, i.e., the musical tone adjustment unnecessary keyboard portion. Alternatively, an adjustment function of the rotary body is set by, e.g., a selection switch button or the like on the operation board, and musical tone control is performed in accordance with a rotational amount of the rotary body on the basis of the selected function In addition, since the intermediate member for connecting the pivot shaft body and the rotary body is arranged, an external load acting on the pivot shaft body of a operation amount detector can be reduced.

According to the present invention, since musical control roll bars (rotary bodies) divided along the keyboard are arranged in front of the keyboard, the performer can rotate a roll bar at a position corresponding to the depressed key with a single hand depressing the key, thereby controlling the musical tone corresponding to each key and hence improving usability and operability of the electronic musical instrument. Therefore, elaborated musical tone control can be achieved and musical expressions can be improved.

Since the operation position for the roll bars is movable, only the roll bar at a position corresponding to a keyboard portion requiring the musical tone control can be pivoted and operated. Therefore, an erroneous operation of the roll bar by the hand which depresses the key or keys which do not require musical tone control is prevented.

The musical tone control roll bars of the electronic musical instrument are arranged in front of the keyboard, and control functions of the roll bars can be selectively designated. Therefore, volume control of a monophonic tone, accompanying tones, and rhythm tones, and various other musical tone adjustment operations such as a modulation or changes in tone colors can be easily performed by, e.g., selection buttons. Each musical tone can be selectively controlled in accordance with rotational amounts of each roll bar.

Moreover, in the musical tone control mechanism according to the present invention, an external load acting on the pivot shaft body such as the operation detector, i.e., the volume control, can be reduced by the intermediate member. As a result, deformation of the volume control and the like by an external impact force can be effectively prevented, thus improving durability and reliability of the electronic musical instrument.

DESCRIPTION OF THE PREFERRED EMBODIMENTS

Figure 1:
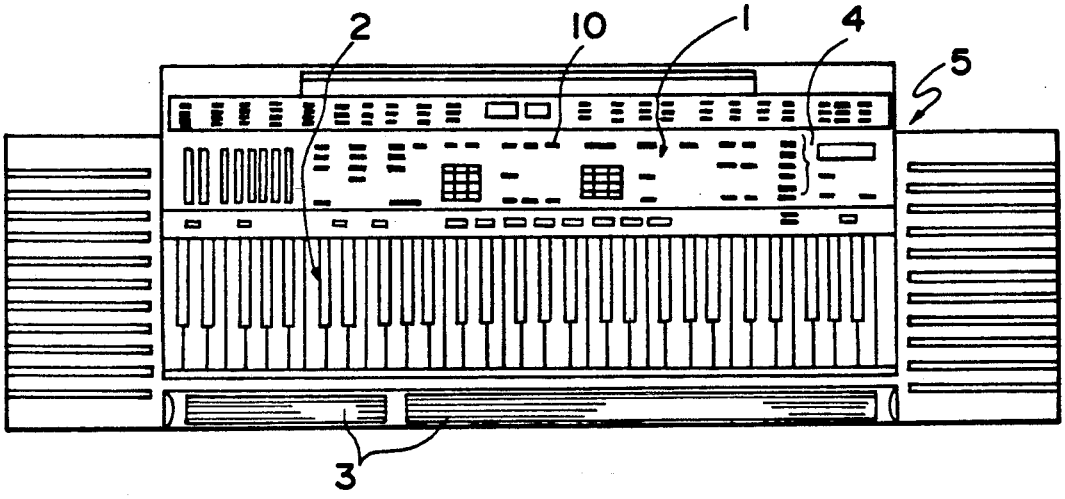
FIG. 1 is a plan view of an electronic musical instrument according to the present invention.
Figure 2:
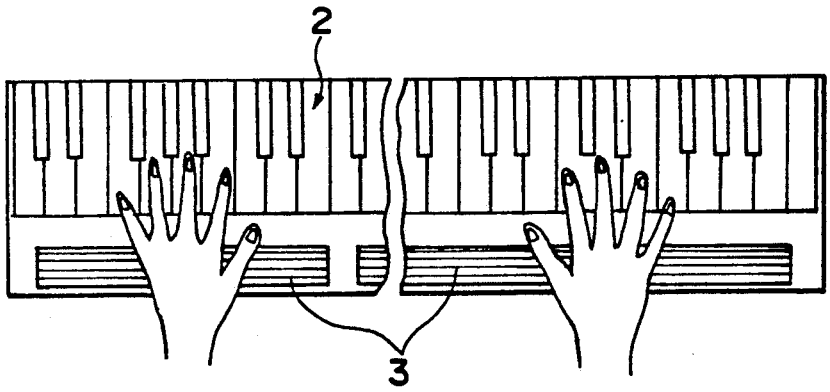
FIG. 2 is a view for explaining actual use of the electronic musical instrument according to the present invention.

FIG. 1 is a plan view showing an embodiment of an electronic musical instrument according to the present invention. A musical instrument main body 5 comprises an operation board 1 and a keyboard 2. Various operation buttons 10 are arranged on the operation board 1, and the keyboard 2 is located in front of the operation board 1. Two musical tone control wheels (roll bars) 3 serving as cylindrical rotary bodies each having a rotating shaft are arranged in front of the keyboard 2. The roll bars 3 control tone colors, pitches, volume levels, and the like of musical tones in accordance with keyboard portions corresponding to melody and musical accompaniment parts. In this embodiment, the left short roll bar 3 controls musical tones of the accompaniment part, and the right long roll bar 3 controls musical tones of the melody part. Mark lines M (FIG. 3) are respectively formed on the roll bars 3 along the longitudinal direction of the keyboard so as to allow a performer to visually check an operation amount. A musical tone adjustment function of each roll bar 3 can be designated upon selective depression of selection buttons 4 on the operation board 1, thereby performing desired musical tone control.

The function selection buttons 4 for the roll bars 3 consist of six buttons, i.e., a solo volume control button, an orchestra volume control button, an accompaniment volume control button, a modulation control button, a tone color control button, and a total volume control button. These button functions will be described below. The solo volume control button controls a volume level of a monophonic tone in a melody performance. The orchestra volume control button controls volume levels of tones except for tones of chord, accompaniment, and solo parts. The accompaniment volume control button controls volume levels of tones of the accompaniment part. The modulation control button controls a modulation. The tone color control button adjusts tone colors of the respective tones. The total volume control button controls a total volume control of the solo, orchestra, and accompaniment parts. The means for selecting the musical tone adjustment functions may be provided to one of the bars (e.g., the right roll bar for the melody part), and the function of the remaining bar may be fixed (e.g., pitch control)

Figure 3:
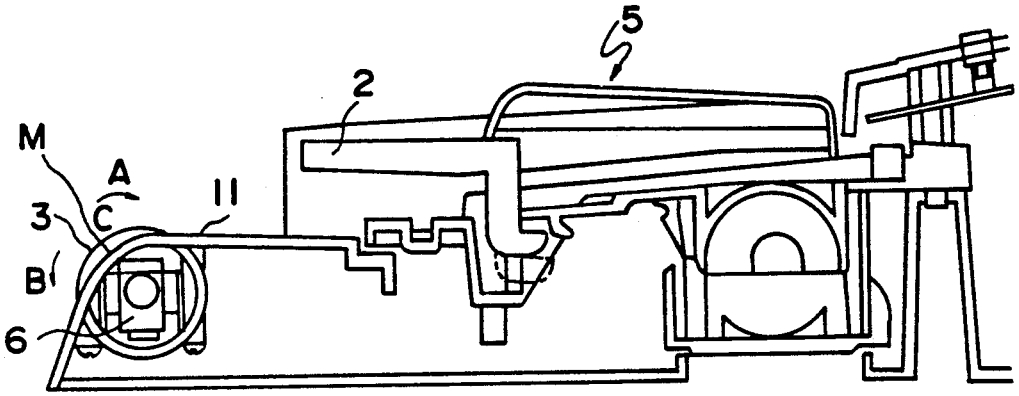
FIG. 3 is a sectional view of the electronic musical instrument according to the present invention.

During a musical performance, the performer plays the keyboard with both hands, while he or she rotates the roll bars by the palms of the corresponding hands in correspondence with the keyboard parts, thereby adjusting the musical tones on the basis of the function selected by the desired selection button corresponding to each keyboard portion FIG. 3 is a sectional view of an electronic musical instrument having the above arrangement. The roll bars 3 are arranged in a front portion of a frame 11 of the musical instrument main body 5 such that the upper surfaces and the front side portions of the roll bars 3 are exposed from the frame 11. A rotary volume control 6 is mounted at an end of each roll bar 3. The rotary volume 6 is rotated upon rotation of the corresponding roll bar 3, and a musical tone is controlled through an electronic circuit (not shown) on the basis of a change in resistance corresponding to a rotational amount of the volume. Detection of rotation of the roll bar 3 is not limited to detection by the rotary volume, but can be replaced by detection of a change in light amount using a photoresistor, a change in magnetic field, and any other appropriate means. In the embodiment shown in FIG. 3, each roll bar is biased by a hairspring (not shown). When the roll bar 3 is pivoted from the neutral position C representing a standard musical tone state to a direction indicated by an arrow A or B and is released, the roll bar 3 returns to the neutral position C.

Figure 4:
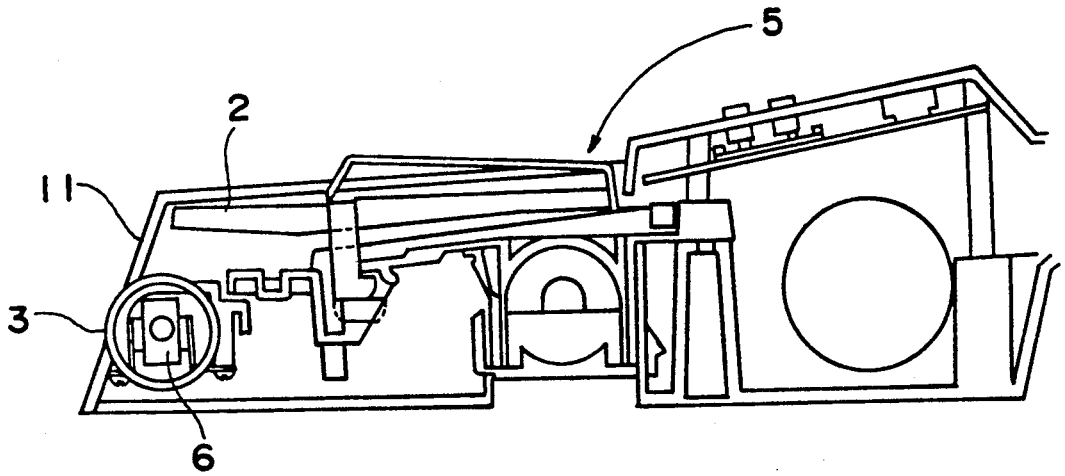
FIG. 4 is a sectional view showing another electronic musical instrument according to the present invention.

FIG. 4 shows another arrangement of the musical tone adjustment operation roll bar 3. In this arrangement, only the front side portion of the roll bar 3 is exposed from a frame 11 of a musical instrument main body 5. Other arrangements and operations of the roll bar in FIG. 4 are the same as those in FIG. 3.

Figure 5:
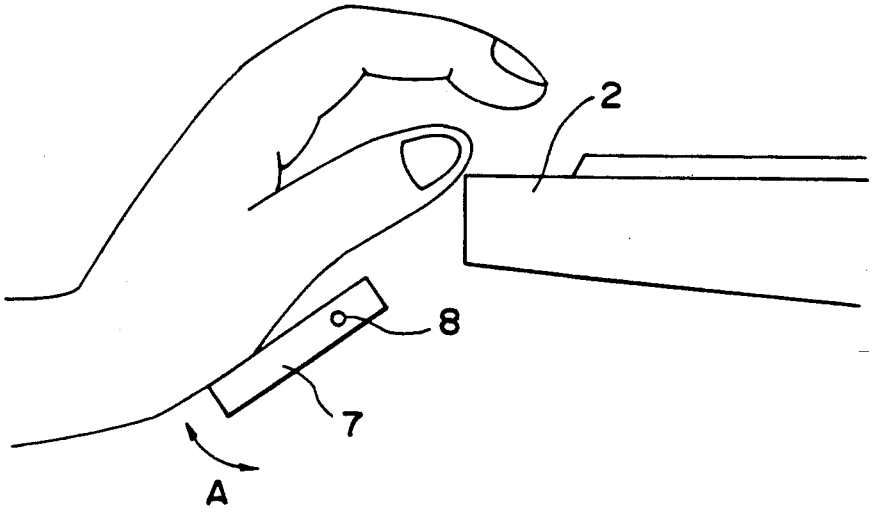
FIG. 5 is a view showing another musical tone control rotary body for an electronic musical instrument according to the present invention.

Another musical tone adjustment operation rotary body is shown in FIG. 5. An operation plate 7 is pivotally mounted on a rotating shaft 8 extending along a keyboard 2. The operation plate 7 is pivoted by a palm of a hand in a direction indicated by an arrow A. The cross-sectional shapes of the roll bar 3 and the operation plate 7 are not limited to a cylindrical shape, but can be a polygonal shape such as a triangular shape, or any other shape.

Figure 6:
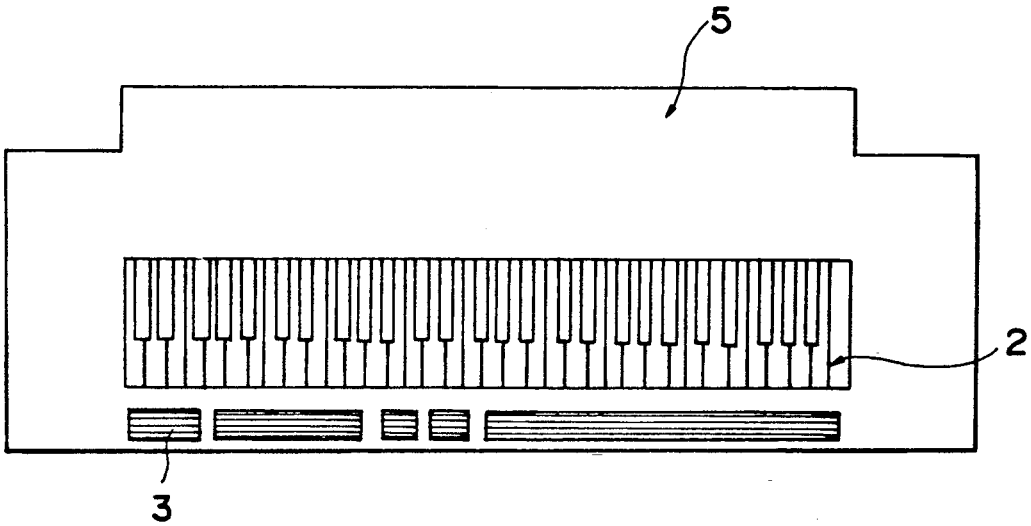
FIG. 6 is a plan view showing still another electronic musical instrument according to the present invention.

FIG. 6 is plan view showing another embodiment of an electronic musical instrument according to the present invention. In this embodiment, the musical tone adjustment operation roll bar 3 is divided into five roll bars to perform elaborated musical tone adjustment corresponding to the keyboard. The number of roll bars 3 is not limited to 2 or 5,, but can be an arbitrary number.

Figure 7:
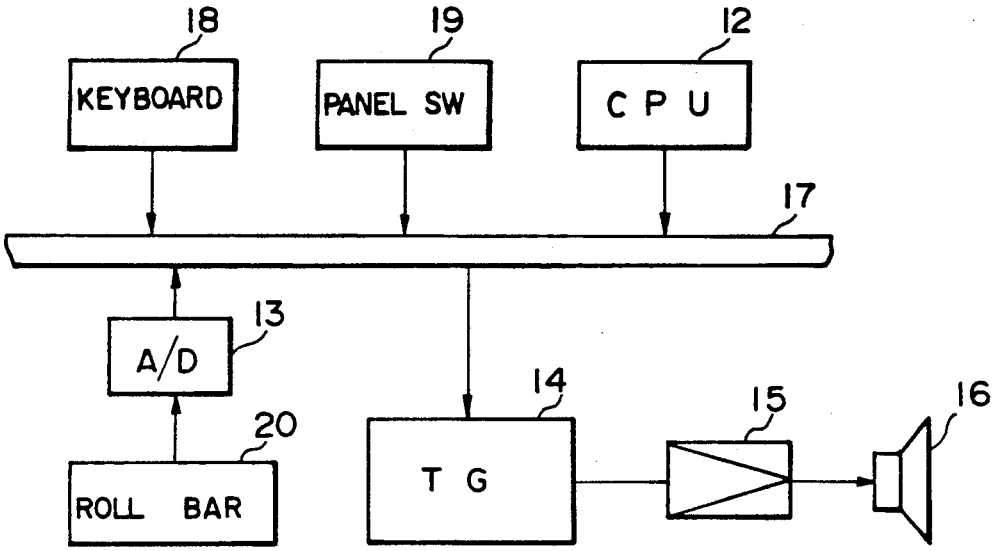
FIG. 7 is a schematic block diagram of basic hardware of an electronic musical instrument according to the present invention.

FIG. 7 is a schematic block diagram of basic hardware of an electronic musical instrument according to the present invention. This electronic musical instrument is operated and controlled by a central processing unit (CPU) 12. The CPU 12 is connected to a keyboard circuit 18 for supplying a key input signal from the keyboard through a bidirectional bus line 17, switches 19 including roll bar function selection buttons on the operation board (panel) to input switch depression signals, a roll bar rotation detector 20, an A/D converter 13 connected to the roll bar rotation detector 20, and an electronic tone control tone generator 14. A speaker 16 is connected to the tone generator 14 through an amplifier 15. The CPU 12 includes a read only memory (ROM) for storing control programs and registers for temporarily storing various data for executing these programs. The tone generator 14 has a plurality of key depression tone forming channels, e.g., eight musical tone generation channels. A musical tone signal is formed on the basis of key depression (key on) data, key release (key off) data, tone color data (or musical instrument type data), and pitch (key name) data supplied from the CPU 12 in units of channels. The musical tone signal is amplified by the amplifier 15, and the amplified signal is externally produced through the speaker 16.

Figure 8:
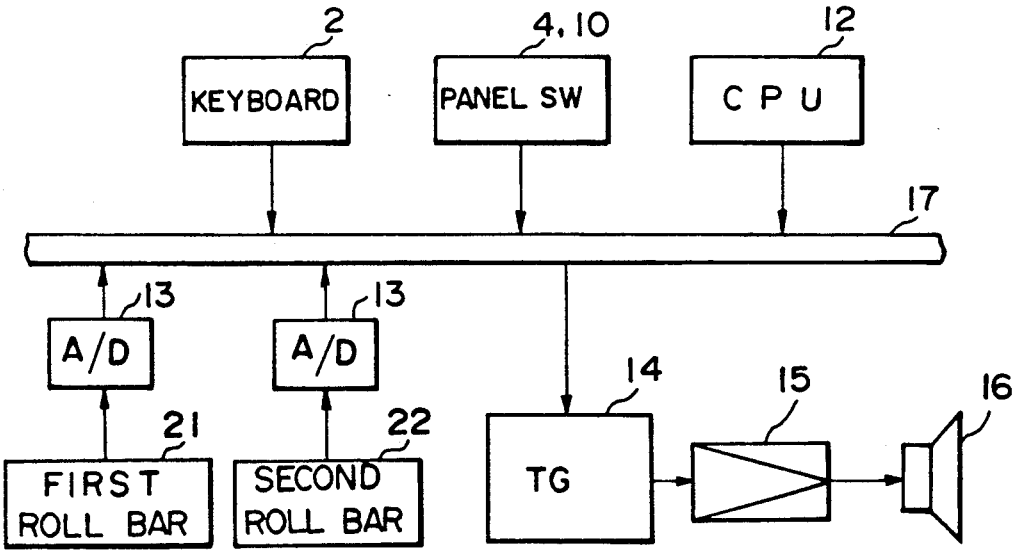
FIG. 8 is a schematic block diagram of hardware wherein the roll bar of an electronic musical instrument according to the present invention is divided into two roll bars.

FIG. 8 shows electronic musical instrument hardware consisting of a first roll bar 21 and a second roll bar 22, which are obtained by dividing the single roll bar into two parts. Other arrangements of the hardware shown in FIG. 8 are the same as those in FIG. 7.

Figure 9:
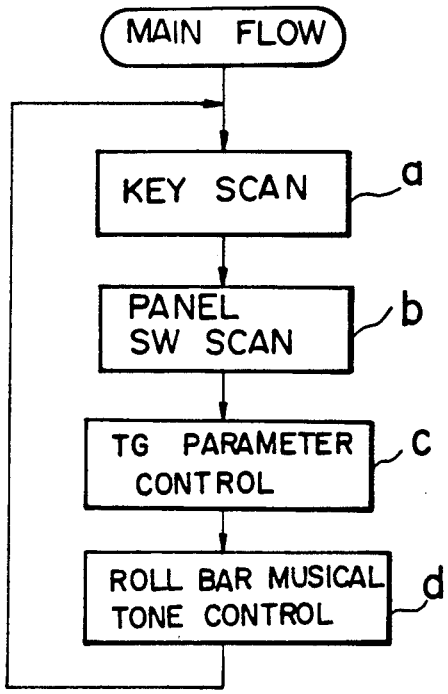
FIG. 9 is a flow chart of a basic operation of an electronic musical instrument according to the present invention.

FIG. 9 is a schematic flow chart showing a main flow of a basic operation of the musical tone adjustment operation roll bar on the basis of the hardware shown in FIG. 7. A key scan operation is performed by a keyboard operation in step a. A tone generated by the tone generator 14 on the basis of a signal input from the keyboard circuit 18 is controlled in correspondence with each depressed key. A panel switch scan operation is performed to scan a depression of each switch button on the operation board (panel) through the switches 19 under the control of the CPU 12 in step b. The operations in step b include a scan operation of the roll bar function selection buttons. Tone color parameters corresponding to the operations of the buttons of the panel switches are input to the tone generator 14 in step c. This step includes an operation for writing a specific target number of the selected roll bar function in the CPU 12. A musical tone control operation by the roll bar is performed in step d to control the musical tone on the basis of a predetermined selection function written in the CPU 12 in accordance with rotation of the roll bar.

Figure 10:
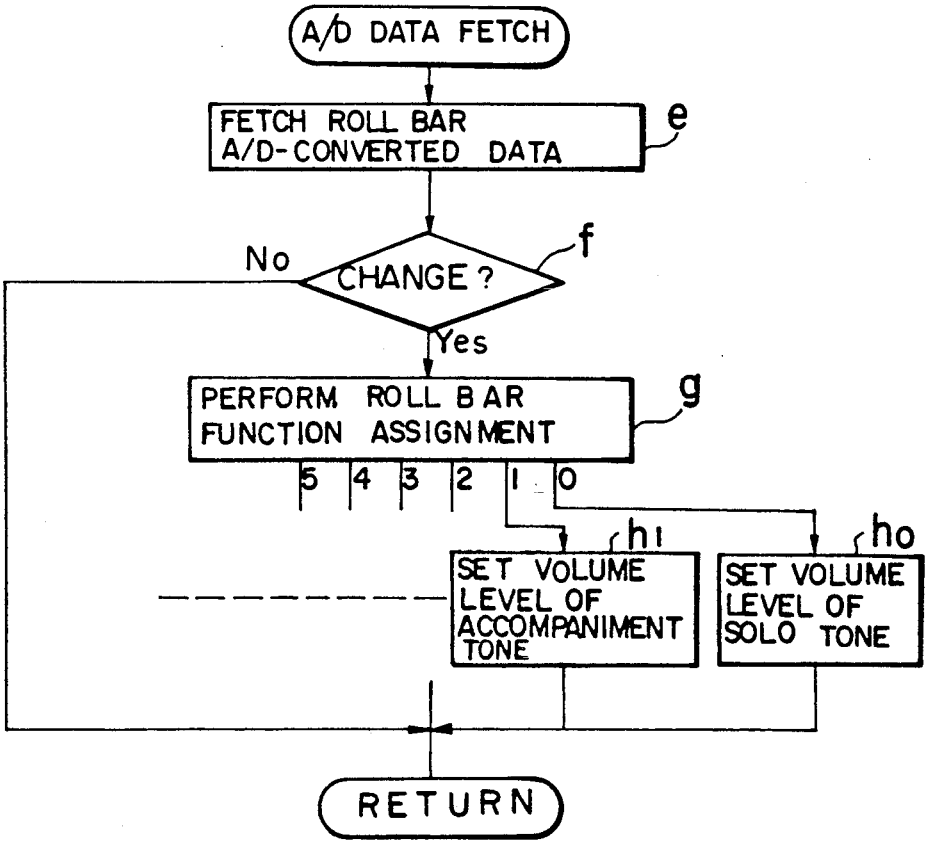
FIG. 10 is a flow chart of a basic operation of a musical tone control mechanism for an electronic musical instrument according to the present invention.

A data fetch operation upon rotation of the roll bar is shown in FIG. 10. In step e, a rotational amount of the roll bar is A/D-converted into digital data, and the digital data is fetched by the CPU 12. The CPU 12 determines in step f whether the fetched data is changed. When the roll bar is kept rotated, the change in data is detected Otherwise, no chang.: is detected. In the latter case, the flow returns to step a in FIG. 9 to repeat musical tone control from the key scan. However, if the rotation state of the roll bar is detected, the rotational amount data input destination is classified into the six functions (No. 0 to No. 5) in step g on the basis of the specific target number write data (step c in FIG. 9) of the selected roll bar function A volume level, a pitch, a tone color, and the like of a solo tone, an accompaniment tone, or the like are determined in steps h0, h1, . . . on the basis of the function selected in accordance with the rotational amount of the roll bar. An electronic tone is generated by musical tone control, the flow returns to step a in FIG. 9, and operations from the key scan are repeated. The musical tone control flow of one roll bar is shown in FIG. 10.

Figure 11:
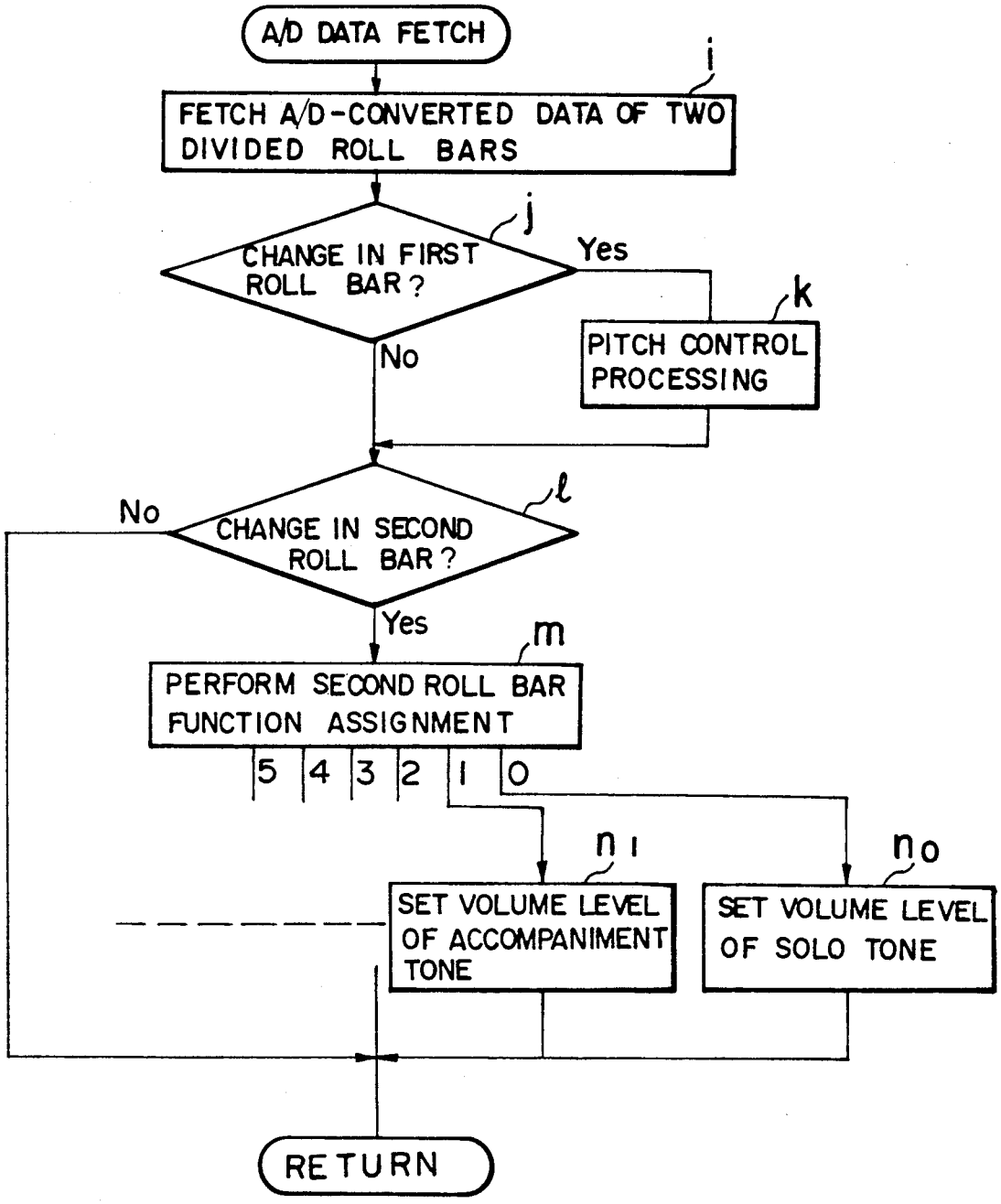
FIG. 11 is a flow chart showing an operation of the two divided musical control roll bars according to the present invention.

A musical tone control flow of two roll bars is shown in FIG. 11. In this arrangement, the left first roll bar in FIG. 1 is used to control only the pitch, and a function selecting means for pitch control is not added to the first roll bar. The function selecting means having the six selection buttons, as previously described, is added to the right second roll bar. A/D-converted data corresponding to rotational amounts of the respective roll bars are input in step i. The CPU 12 then determines in step j whether a change in rotating state of the first roll bar occurs. If the first roll bar is determined not to be rotated, the flow advances to step l. However, when the first roll bar is determined to be rotated, pitch control is performed by adjusting a waveform frequency of a tone to be generated in step k. The flow then advances to step l. The operations from step l are the same as those of the flow in FIG. 10. The data corresponding to a change in rotating state of the second roll bar is assigned to the selected one of the six functions in step m. Musical tones having the selected functions are set to produce the corresponding electronic musical tones in steps n0, n1,. . . .

Figure 12:
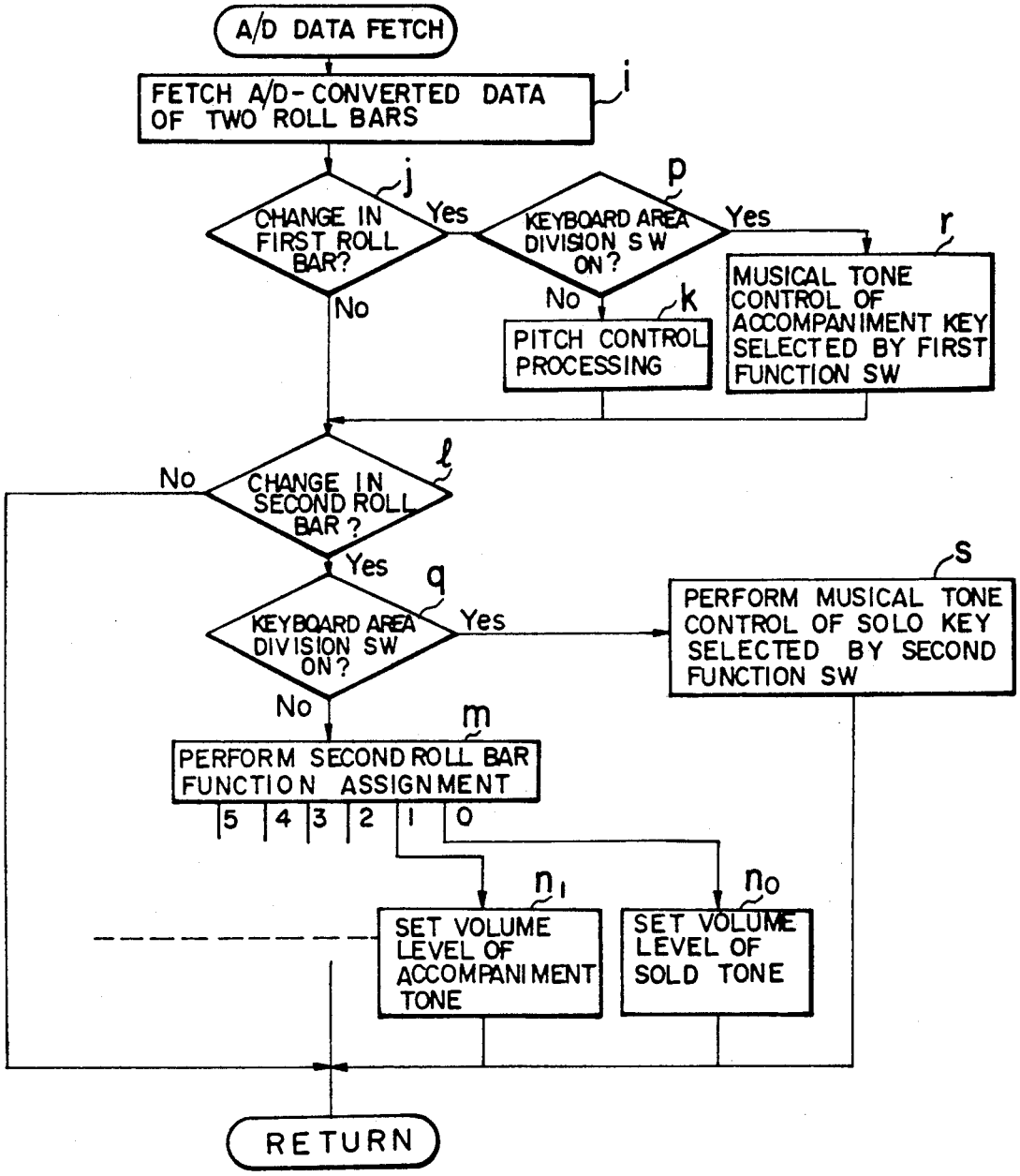
FIG. 12 is a flow chart showing another embodiment of two divided musical control roll bars according to the present invention.

A key area division switch is arranged in an electronic musical instrument and the roll bar is divided in synchronism with an operation of the key area division switch, as shown in a flow of FIG. 12. In this embodiment, a mechanism for independently assigning the first and second roll bars can be selected. That is, it is determined in step P whether the key area division switch for the first roll bar is ON. If YES in step P, flow advances to step r.

Musical tone control of the accompaniment key selected by a first mechanism switch is performed in step r. This musical tone control is performed upon rotation of the first roll bar as described above. It is then checked in step g whether the key area division switch for the second roll bar is ON. If YES in step q, the flow advances to step S. In step S, musical tone control of the solo tone key selected by a second function switch is performed. In this manner, the musical tone functions for the first and second roll bars corresponding to the solo tone keys can be independently controlled.

Figure 13:
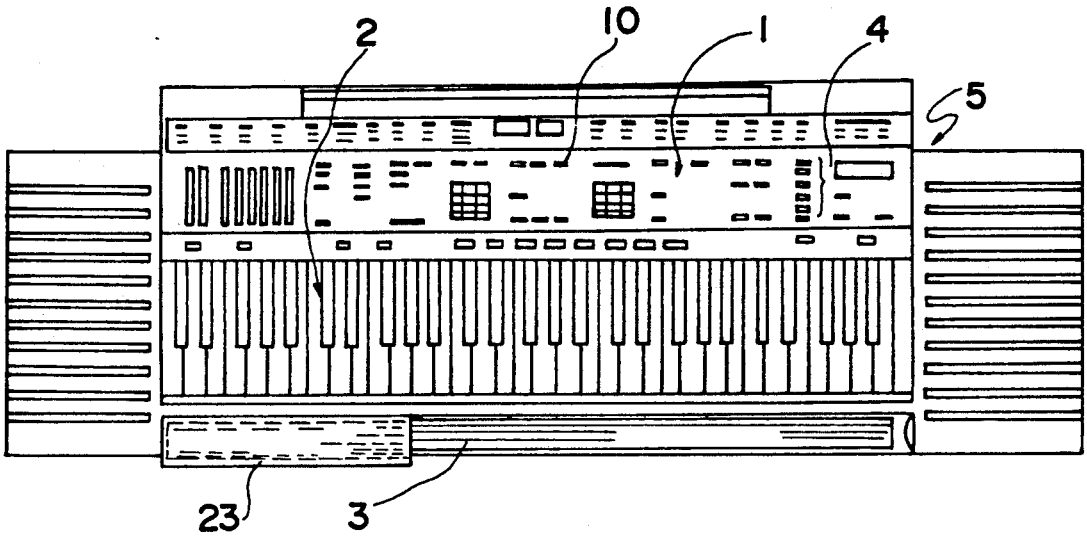
FIG. 13 is a plan view showing another embodiment of an electronic musical instrument according to the present invention.
Figure 14:
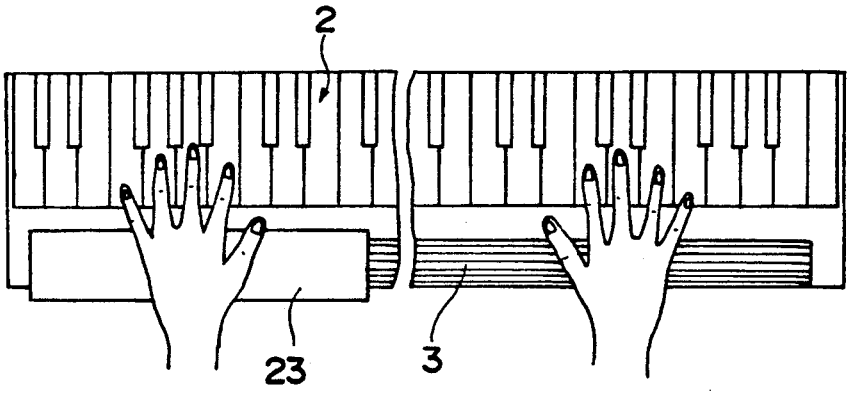
FIG. 14 is a view for explaining actual use of the electronic musical instrument shown in FIG. 13.

FIG. 13 is a plan view of another embodiment of an electronic musical instrument according to the present invention. The same reference numerals as in FIG. 1 denote the same parts in FIG. 13.

A cover 23 is formed on a left accompaniment roll bar 3, i.e., a musical tone adjustment unnecessary portion of a keyboard 2. The roll bar 3 is covered and cannot be pivoted. The cover 23 may have a cylindrical shape to cover the entire surface of the roll bar 3 or may have a shape to cover only the upper and front surfaces of the roll bar exposed from the musical instrument main body. This cover 23 may be arranged to be movable along the keyboard to prevent pivotal movement of a roll bar 3 corresponding to a desired keyboard portion. Alternatively, covers 23 having different lengths may be prepared and selectively used.

When this electronic musical instrument is played, the left hand which plays the left keyboard portion is not brought into contact with the roll bar 3 due to the presence of the cover 23. Therefore, the roll bar 3 is not erroneously operated by the hand which operates the keyboard portion.

Figure 15:
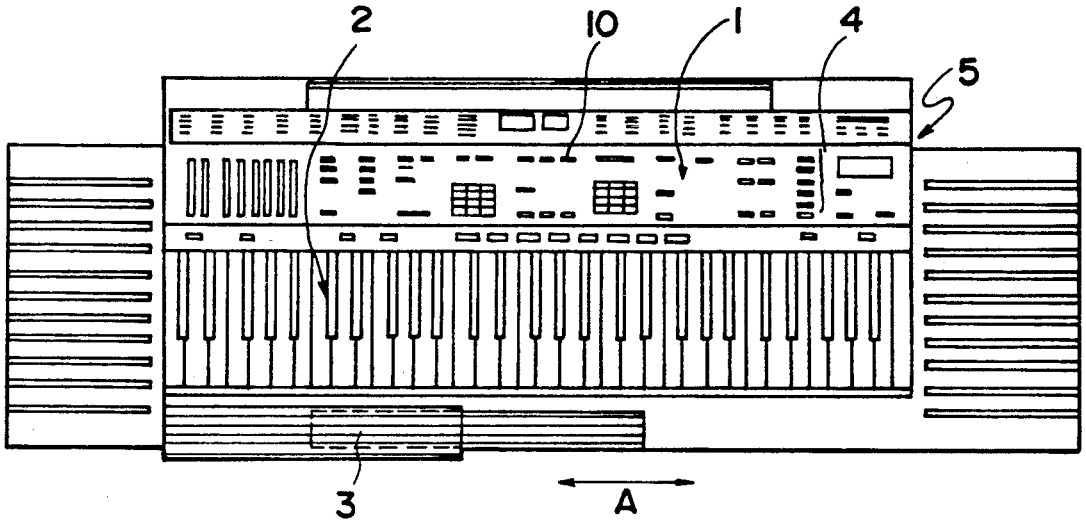
FIG. 15 is a plan view showing another arrangement of a mechanism for variably controlling a rotating operation position of roll bars shown in FIG. 13.

Another mechanism for variably controlling a pivot operation position of the musical tone adjustment roll bar 3 is shown in FIG. 15. In this arrangement, a roll bar 3 is telescopically extendible along a direction indicated by an arrow A. The number of extendible steps is not limited to two, but can be three or more. Any roll bar is not located at a portion corresponding to a musical tone adjustment unnecessary keyboard portion (the right keyboard portion in this embodiment). Therefore, the roll bar 3 cannot be pivoted by the hand which operates the corresponding keyboard portion.

Figure 16:
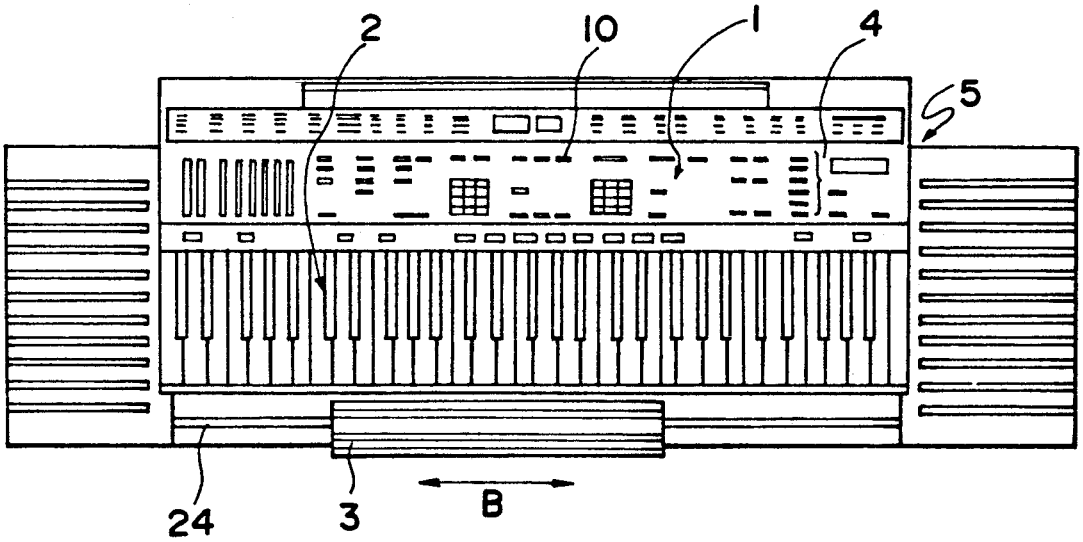
FIG. 16 is a plan view showing another arrangement of a mechanism for variably controlling a rotating operation position of roll bars shown in FIG. 13.

Still another mechanism for variably controlling a pivot operation position of a musical tone adjustment roll bar 3 is shown in FIG. 16. In this arrangement, the length of the roll bar 3 itself is decreased. The roll bar 3 is mounted on a rotating shaft 24 to be slidable and rotatable thereon by means of a spline structure. When the roll bar 3 is slid along the rotating shaft 24 in a direction indicated by an arrow B and is located at a desired position, the pivot movement at a portion corresponding to a desired keyboard portion can be allowed.

Changes in rotational amount of the roll bar 3 for the tone color, tone volume, pitch, and the like, and a change direction, i.e., an increase or decrease in rotational amount can be adjusted upon operation of switches 10 connected to an electronic control circuit.

Figure 17:
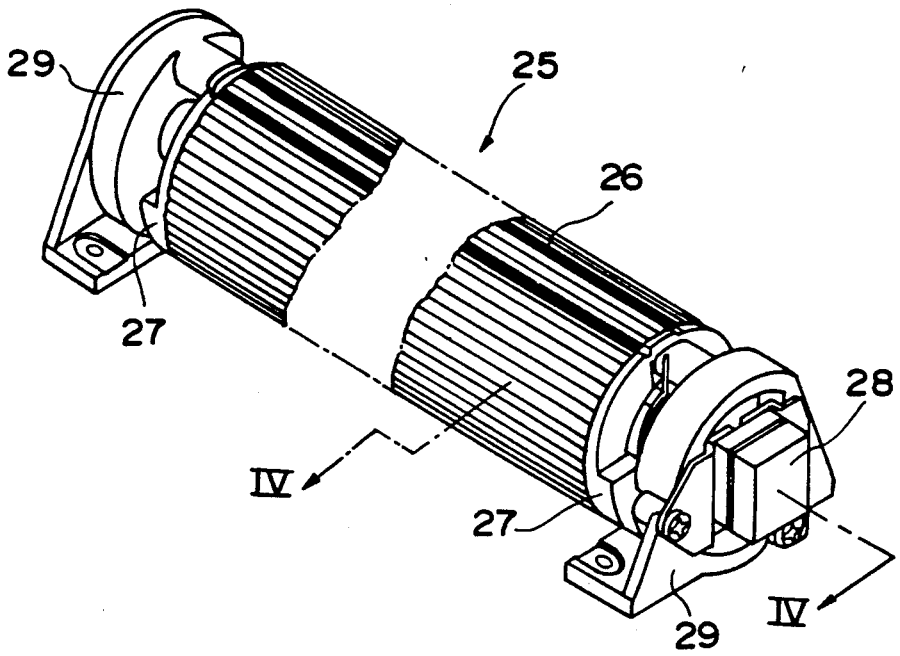
FIG. 17 is a perspective view showing an overall arrangement of a musical control mechanism according to the present invention.

FIG. 17 is a perspective view showing an embodiment of a musical tone control mechanism according to the present invention.

As is apparent from FIG. 17, a musical tone control mechanism 25 in this embodiment comprises a cylindrical wheel 26 (operation portion) 26, caps 27 fitted on the end openings of the wheel 26, a volume control (operation amount detector) 28 having a pivot shaft body 28A (FIG. 19) fitted in an intermediate member 27A (FIG. 19) extending from one cap 27, and bearings 29 having through holes (bearing holes) 29A which receive the intermediate members 27A.

Figure 18:
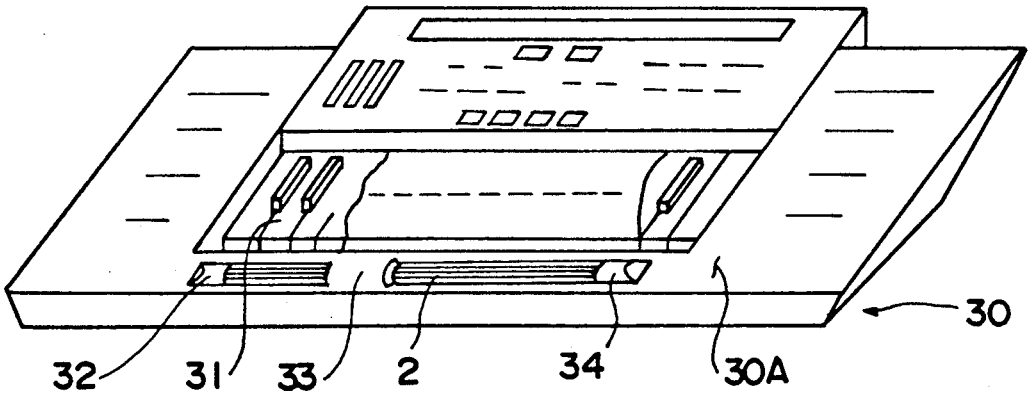
FIG. 18 is a schematic view showing an overall arrangement of an electronic musical instrument having the musical tone control mechanism.

As can be understood from FIG. 18, the musical tone control mechanisms 25 are disposed on an upper panel 30A of an electronic musical instrument 30 in front of a keyboard 31. The wheels 26 have almost the same length as the length of the keyboard 31. The wheels 26 is fixed by three fixing portions 32, 33, and 34 formed on the upper panel 30A.

The portions near the end bearings 29 are fixed by the fixing portions 32 and 33 and the fixing portions 33 and 34, respectively.

The musical tone control mechanism disposed between the fixing portions 33 and 34 will be described with reference to FIGS. 19 and 20.

Figure 19:
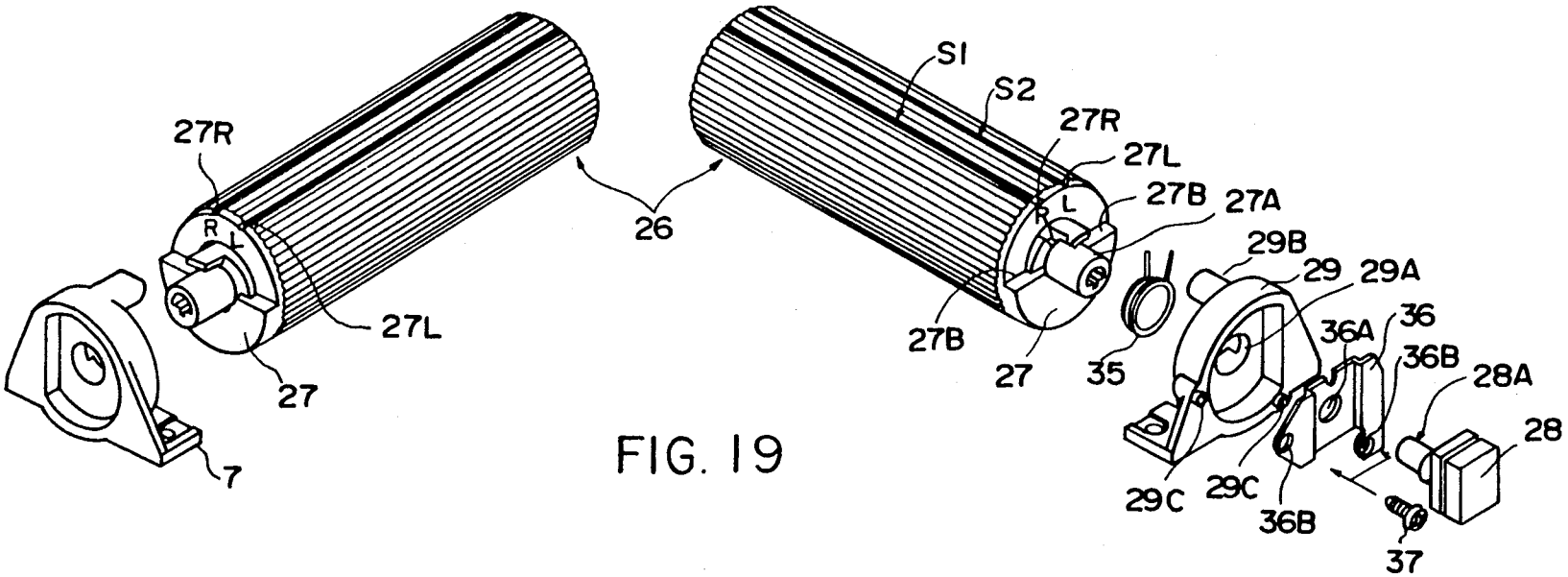
FIG. 19 is an exploded perspective view of the musical tone control mechanism.
Figure 20:
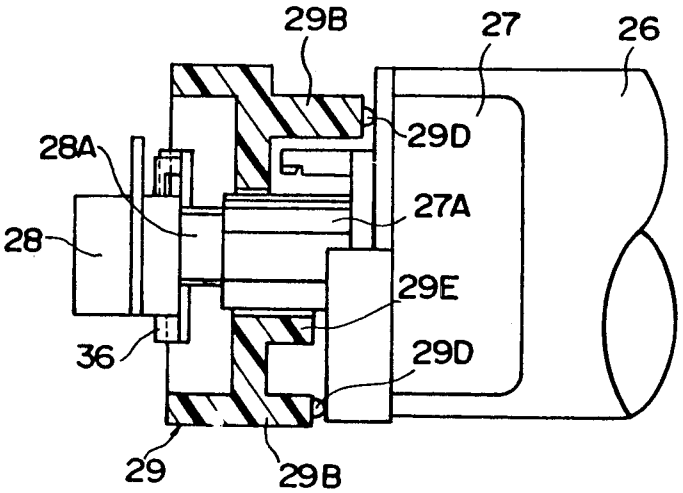
FIG. 20 is a sectional view showing a state wherein the musical tone control mechanism is assembled when taken along the line IV—IV of FIG. 18.

Referring to FIGS. 19 and 20, each cap 27 has almost the same size and shape (circular shape) as the end face of the wheel 26. The cap 27 has two notches 27R and 27L on its circumference at positions angularly spaced apart by 15°.

A linear index S1 is formed in correspondence with the position of the notch 27R along the longitudinal direction of the wheel 26. The index S1 is formed during formation of the wheel 26 by two-color extrusion molding such that the index S1 is light gray in color and the remaining portion S2 is dark gray in color.

For the above reason, forming efficiency of the wheel 26 can be improved as compared with a conventional method of forming a separate index member and adhering it to the wheel or painting the index on the wheel because the method of the present invention has a smaller number of manufacturing steps.

The index S1 is located at a predetermined inclination angle (7.5° in this embodiment) from the position normal to a surface on which the electronic musical instrument is placed. The performer can clearly observe the index S1.

The notch 27R of each cap has a function of aligning the wheel 26 with the caps 27 in a predetermined positional relationship.

In this embodiment, a return spring 35 is arranged to bias the wheel 26 so that the index S1 is always kept at a predetermined position unless a rotational force acts on the wheel 26. When the performer rotates the wheel 26 and then releases it, the wheel 26 returns to the predetermined position. However, the spring 35 need not be arranged in the musical tone control mechanism.

Each cap 27 has a stopper 27B for limiting the pivotal angle (defined within a predetermined angle) of the wheel 26 and a cylindrical boss 27A (intermediate member) which is engaged with a pivot shaft body 28A (integrally formed with the volume control 28) serving as a pivot shaft of the wheel 26.

The outer diameter of each pivot shaft body 28A and the inner diameter of the matching boss 27A are determined such that the boss 27A is rotated together with the pivot shaft body 28A when the pivot shaft body 28A is engaged with the boss 27A.

Each pivot shaft body 28A is fitted in the corresponding boss 27A through a through hole 36A of an external load damping metal piece 36. Each boss 27A is pivotally fitted in the through hole (bearing hole) 29A formed in the corresponding bearing 29.

However, the pivot shaft body 28A may be formed on each cap 27, and the boss 27A may be formed in the volume control 28. It is essential that the inner surface of the bearing hole 29A is not in contact with the outer surface of the pivot shaft body 28A directly but through the boss 27A.

In this embodiment, the metal piece 36 is fixed on the bearing 29 to absorb an external impact force acting on the pivot shaft body 28A. This metal piece 36 is fixed by threadable engagement of screws 37 in screw holes 36B formed in the metal piece 36 and screw holes 29C formed in the bearing 29.

A projection 29E is formed on each bearing 29 to absorb the external impact force in addition to the metal piece 36. When the wheel 26 is rotated clockwise (FIG. 20) by the projection 29E, that is, even if a large force erroneously acts on the wheel 26, deformation of the volume control 28 can be prevented.

A stopper 29B extends on each bearing 29. The stopper 29B abuts against the stopper 27B of the corresponding cap 27 to prevent pivotal movement of the wheel 26. A semispherical projection 29D is integrally formed at the distal end of the stopper 29B to obtain an optimal frictional resistance obtained when the bearing 29 is engaged with the corresponding cap 27.

According to this embodiment, as described above, the wheel 26 is arranged in front of the keyboard 31, and the volume control 28 (pivot shaft body 28A) of the wheel 26 is supported by the corresponding bearing 29 through the corresponding boss 27A.

Even if an external load (impact force) acts on the pivot shaft bodies 28A, the external load can be absorbed. Therefore, deformation or the like of the pivot shaft bodies 28A can be effectively prevented.

In addition, in the above embodiment, since the external load damping metal pieces 36 are arranged, the external load acting on the pivot shaft bodies 28A can be further reduced, and durability and reliability of the musical tone control mechanism can be further improved.

The shape of the wheel 26 is not limited to a cylindrical shape, but can be a columnar shape such as a prism shape. The length of the wheel 26 can be changed in correspondence with the number of keys in the keyboard, and the wheel 26 can be used for other electronic musical instruments In the above embodiment, the roll bar returns to the neutral position when no force acts thereon The roll bar rotation mechanism is not limited to this construction. If no force is applied, the wheel may be stopped at the present angular position Alternatively, the wheel may be returned to the neutral position when it is rotated in the A direction (or the B direction) and released, but may not be returned to the neutral position but stays at the present angular position when it is rotated in the B direction and released. Various other rotation mechanisms can be proposed A mark corresponding to the mark M may be formed at the neutral position of the main body, thereby further improve readability of the mark.

What is claimed is:

1. A musical tone control mechanism for an electronic musical instrument, comprising:

a keyboard;

a musical tone adjustment rotary body which is divided into a plurality of parts and arranged in front of the keyboard in a longitudinal direction of the keyboard, the parts being respectively rotated by a performer so as to control musical tone elements corresponding to the parts;

a detecting means connecting to the parts for detecting a rotation amount of each of the parts; and a musical tone element being controlled based on the rotation amounts of the rotary body parts.

2. A mechanism according to claim 1, wherein the operation position of said rotary body is movable along the longitudinal direction of said keyboard.

3. A mechanism according to claim 1, further comprising means for selecting the adjustment function of said rotary body for a musical tone.

4. A musical tone control mechanism for an electronic musical instrument, comprising:

a keyboard;

a musical tone adjustment device including a rotary body and a rotating shaft, the rotary body arranged in front of said keyboard along the longitudinal direction of the keyboard, rotated by a performer so as to control a musical tone element and being movable along the longitudinal direction of the keyboard to position the body away from a portion of the keyboard to thereby avoid erroneous rotation of the body;

a detecting means connecting to the rotary body for detecting a rotation amount of the rotary body, wherein the musical tone element is controlled based on the rotation amount of the rotary body.

5. A mechanism according to claim 4, wherein said rotary body is telescopically extendable along the longitudinal direction of the keyboard.

6. A mechanism according to claim 4, further comprising a cover member for partially or entirely covering said rotary body along the longitudinal direction of the keyboard.

7. A mechanism according to claim 4, further comprising means for selecting an adjustment function of said rotary body for a musical tone.

8. A musical tone control mechanism for an electronic musical instrument, comprising:

a keyboard;

a musical tone adjustment device including a rotary body and a rotating shaft, the rotary body being arranged in front of said keyboard and along the longitudinal direction of the keyboard and rotated by a performer so as to control one of a plurality of musical tone parameters;

a detecting means connecting to the rotary body for detecting a rotation amount of the rotary body; and a selection means for selecting one of the plurality of the musical tone parameters to be controlled by the rotary body, the selected musical tone parameter being controlled based on the rotation amount of the rotary body, wherein the plurality of the musical tone parameters are controlled by the rotation of the rotary body.

9. A mechanism according to any one of claims 1, 4 and 8, where a cross section of said rotary body is elongated substantially in a direction of a line connecting said keyboard and a performer, and said rotating shaft is shifted towards said keyboard.

10. A mechanism according to any one of claims 1, 4 and 8, further comprising:

cylindrical intermediate members respectively fitted to both ends of said rotary body; and bearings having bearing holes for pivotally receiving said immediate members, respectively, wherein the detecting means has a pivot shaft body and detects the rotation amount of the rotary body as a pivot amount of the pivot shaft body, and wherein the cylindrical intermediate members connect the pivot shaft body and the rotary body.

11. A musical tone control mechanism comprising:

a columnar musical tone control operation portion pivotally about a shaft extended along the longitudinal direction of a keyboard, said operation portion being located in front of said keyboard;

an operation amount detector, having a pivot shaft body for detecting the operation amount of said operation portion as a pivot amount of said pivot shaft body;

cylindrical intermediate members respectively fitted to both ends of said operation portion, for connecting said pivot shaft body and said operation portion; and bearings having bearing holes for pivotally receiving said intermediate members, respectively.

12. A mechanism according to claim 11, wherein a cross section of said musical tone control operation portion is elongated substantially in a direction of a line connecting said keyboard and performer, and said rotating shaft is shifted toward said keyboard.

13. A musical tone control mechanism for an electronic musical instrument, comprising:

a keyboard;

a musical tone adjustment rotary body coupled to a rotating shaft, wherein the rotary body is divided into a plurality of parts and is arranged in front of the keyboard in the longitudinal direction of the keyboard, the parts being respectively rotated by a performer about the shaft so as to control musical tone elements corresponding to the parts, the cross-section of said rotary body being elongated substantially in the direction of a line connecting said keyboard and the performer, the rotating shaft of said rotary body being positioned toward said keyboard;

a detecting means connecting to the parts for detecting a rotation amount of each of the parts; and a musical tone element being controlled based on the rotation amount of the rotary body parts.

14. A musical tone control mechanism for electronic musical instrument, comprising:

a plurality of musical tone adjustment rotary members extending along the longitudinal direction of the keyboard and arranged in front of such keyboard;

detector means for detecting a rotation amount of each of said musical tone adjustment rotary members;

selection means for selecting the musical tone adjustment function of each of said musical tone adjustment rotary members ad desired; and control means for adjusting the musical tone to each tone adjustment function correspondingly to the detected rotation amount of each of said musical tone adjustment rotary members.

* * * * *